US008960530B2

(12) United States Patent
Silke

(10) Patent No.: US 8,960,530 B2
(45) Date of Patent: Feb. 24, 2015

(54) MAIL BOX

(71) Applicant: Neil Silke, Williamstown (AU)

(72) Inventor: Neil Silke, Williamstown (AU)

( * ) Notice: Subject to any disclaimer, the term of this patent is extended or adjusted under 35 U.S.C. 154(b) by 0 days.

(21) Appl. No.: 14/078,762

(22) Filed: Nov. 13, 2013

(65) Prior Publication Data

US 2014/0131431 A1 May 15, 2014

(30) Foreign Application Priority Data

Nov. 13, 2012 (AU) ..... 2012904942

(51) Int. Cl.
*B65G 11/04* (2006.01)
*A47G 29/22* (2006.01)

(52) U.S. Cl.
CPC ..... *A47G 29/22* (2013.01)
USPC ..... 232/47; 232/45

(58) Field of Classification Search
CPC . A47G 29/1209; A47G 29/124; A47G 29/16; A47G 29/22; A47G 2029/148
USPC ..... 232/17, 45, 47–51
See application file for complete search history.

(56) References Cited

U.S. PATENT DOCUMENTS

| | | | | | |
|---|---|---|---|---|---|
| 527,799 | A * | 10/1894 | Martin | 232/47 |
| 572,893 | A * | 12/1896 | Hentz | 232/30 |
| 1,136,979 | A * | 4/1915 | Slagow | 232/48 |
| 1,248,584 | A * | 12/1917 | Williams et al. | 232/47 |
| 5,000,378 | A * | 3/1991 | Dorr et al. | 232/17 |
| 5,137,212 | A * | 8/1992 | Fiterman et al. | 232/43.2 |
| 5,526,979 | A * | 6/1996 | Mann | 232/33 |
| 5,938,113 | A * | 8/1999 | Kim | 232/47 |
| 6,347,737 | B1 * | 2/2002 | Madruga | 232/47 |
| 6,719,195 | B2 * | 4/2004 | Farentinos | 232/45 |
| 7,320,427 | B2 * | 1/2008 | Prestwich | 232/51 |
| 7,946,472 | B2 * | 5/2011 | Bolles | 232/45 |
| 8,573,473 | B1 * | 11/2013 | Farentinos et al. | 232/51 |

* cited by examiner

*Primary Examiner* — William Miller
(74) *Attorney, Agent, or Firm* — Panitch Schwarze Belisario & Nadel LLP

(57) ABSTRACT

A receptacle for receiving and securely storing mail includes a body defining an opening through which mail is received and a storage area into which mail is stored. A door is pivotably mounted within the opening and configured to close the opening in a closed position and to pivot away from the body to facilitate access to the opening in an opened position. A ramp is mounted within the body and configured to receive and direct mail into the storage area. A closing member is pivotably mounted within the body and linked to the door, such that movement of the door from the closed position to the opened position causes the closing member to pivot towards the ramp to substantially prevent access to the storage area from the opening when the door is in an open position.

14 Claims, 6 Drawing Sheets

MAIL BOX

RELATED APPLICATION

The present application claims priority from Australian Provisional Patent Application No. 2012904942, the entire contents of which are incorporated herein by reference.

FIELD OF INVENTION

The present invention relates generally to a mail box or receptacle that is able to receive and store mail in the form of letters and parcels in a secure manner.

BACKGROUND OF THE INVENTION

The use of receptacles, such as mailboxes, post boxes and the like, to receive and store mail for later collection by the owner of the mail is a well established practice. Most buildings typically have a dedicated area or box into which mail belonging to occupants of the building is delivered by postal services, couriers and the like.

Conventionally, mail boxes typically include a slot for receiving mail in the form of envelopes or thin parcels. Such slots are typically of a sufficient size to receive envelopes or parcels of varying thickness into a storage area. The storage area may be lockable to provide a degree of security for the owner of the mail box, and is typically enclosed to protect the delivered mail from exposure to rain, wind and the like. Such conventional mailboxes have typically been unable to receive larger parcels or packages that cannot pass through the slot.

With the increasing popularity of online trading, there has been a significant increase in parcel delivery services to delivery purchases made through online trading sites. Typically, such purchases are delivered by regular mail services or dedicated courier services to an address designated by the purchaser, often a residential address. In instances where the goods purchased are of a size that prevents the goods being delivered into the purchaser's mail box, most delivery services will typically only deliver the goods directly to the purchaser or a delegate of the purchaser, and will not leave the goods unattended due to the possibility of theft. If the purchaser or a delegate is not present, a card is often left in the purchaser's mail box to alert the purchaser of the need to collect the goods at a dedicated collection point, typically at a dedicated time.

It will be appreciated that such a system is inconvenient for both the purchaser and the delivery service as the purchaser will need to find time to attend the dedicated collection point to collect the goods, and the delivery service will have costs associated with an unsuccessful delivery as well as the need to store the item until it is collected.

Thus, there is a need to provide a dedicated receptacle that can be used for the receipt and storage of conventional mail as well as larger parcels, in a convenient and secure manner, without fear of theft or damage to the goods stored therein.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

The invention according to one or more aspects is as defined in the independent claims. Some optional and/or preferred features of the invention are defined in the dependent claims.

Accordingly, in one aspect of the invention there is provided a receptacle for receiving and securely storing mail comprising:

- a body defining an opening through which the mail is received and a storage area into which the mail is stored;
- a door member pivotably mounted within said opening, the door member being configured to close said opening when in a closed position and to pivot away from said body to facilitate access to said opening when in an opened position;
- a ramp member mounted within said body and configured to receive the mail from the opening and to direct the mail into the storage area; and
- a closing member pivotably mounted within said body and linked to the door member such that movement of said door member from said closed position to said opened position causes the closing member to pivot towards said ramp member such that the ramp member and the closing member function to substantially prevent access to said storage area from said opening.

In one embodiment, the ramp member comprises a substantially planar member mounted to the body below said opening, the substantially planar member having a downwardly directed portion that defines a surface for receiving the mail and directing the mail into the storage area.

The closing member may travel over the surface of the downwardly directed portion of the substantially planar member to substantially prevent access to the storage area from the opening when the door member moves from the closed position to the opened position.

The closing member may comprise a substantially planar flap member that extends at least partially across an internal region of the body. The flap member may be mountable to an upper region of the body by one or more hinges to facilitate pivotal movement of the flap member within the body. The flap member may have a lower edge that travels over the surface of the downwardly directed portion of the substantially planar member such that the gap between the lower edge of the flap member and the surface of the downwardly directed portion of the substantially planar member is reduced to substantially prevent access to the storage area from the opening when the door member moves from the closed position to the opened position.

The door member may have a slot formed therein through which mail may be inserted for receipt within the storage area without requiring said door member to be opened.

The door member may further comprise a baffle member that extends substantially orthogonally with respect to the door member along an inner and upper edge thereof. The door member may biased into a closed position by way of one or more biasing members. The one or more biasing members may include one or more springs or counter weights.

In one form, the receptacle may be incorporated within a fence or wall. In another form, the receptacle may be a standalone device.

BRIEF DESCRIPTION OF THE DRAWINGS

The invention may be better understood from the following non-limiting description of preferred embodiments, in which.

DETAILED DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention.

The present invention will be described below in relation to a receptacle for receiving mail that has a substantially rectangular shape. However, it will be appreciated that the shape and size of the receptacle may vary in accordance with aesthetic or application requirements and still fall within the spirit of the present invention. Further, in the description provided below, the term mail will be used to refer to mail consisting of envelopes as well as parcels and packages which may be received by the receptacle according to the present invention.

Figure 1A:
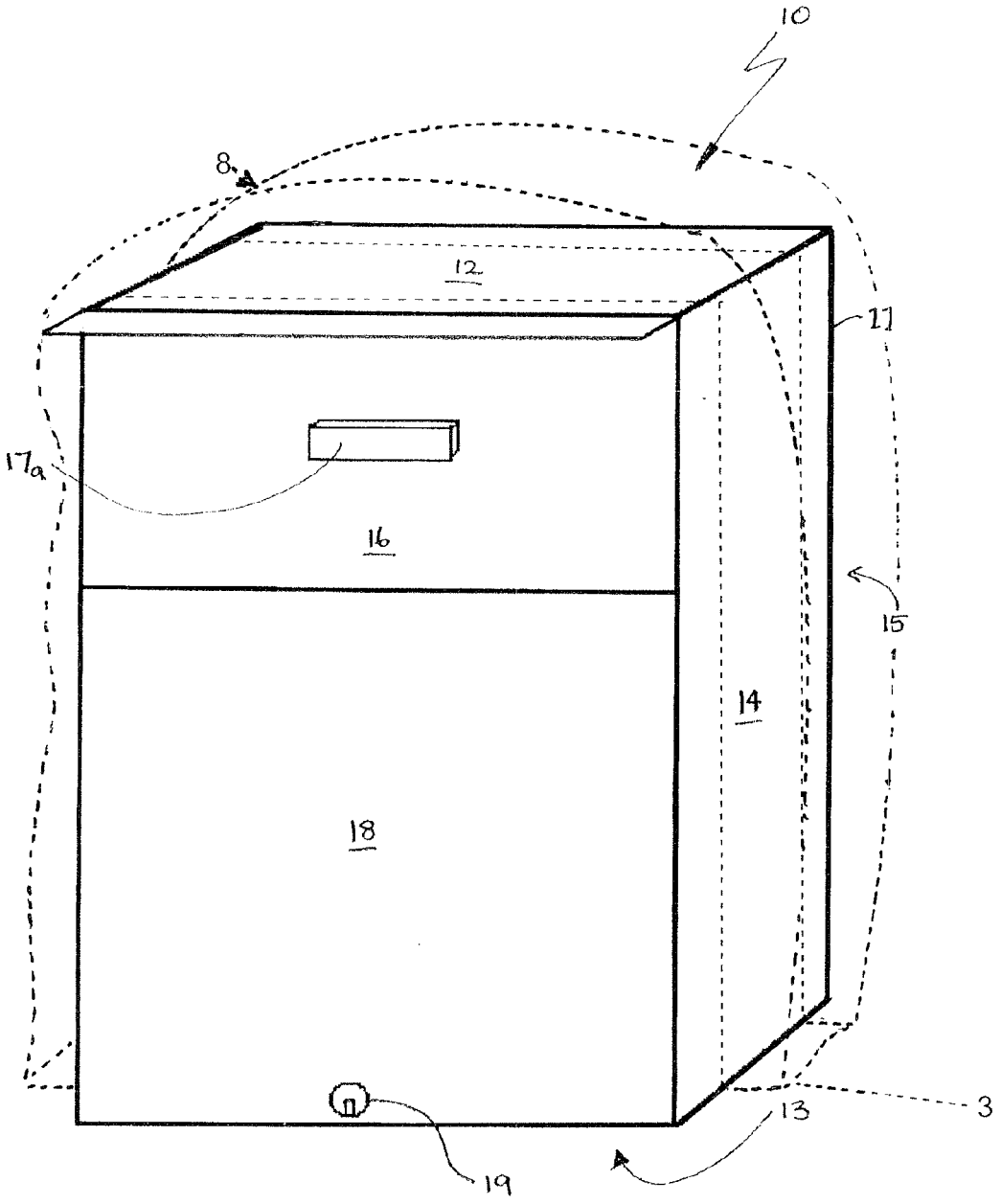
FIG. 1A is a front perspective view of a mail receptacle in accordance with an embodiment of the present invention.
Figure 1B:
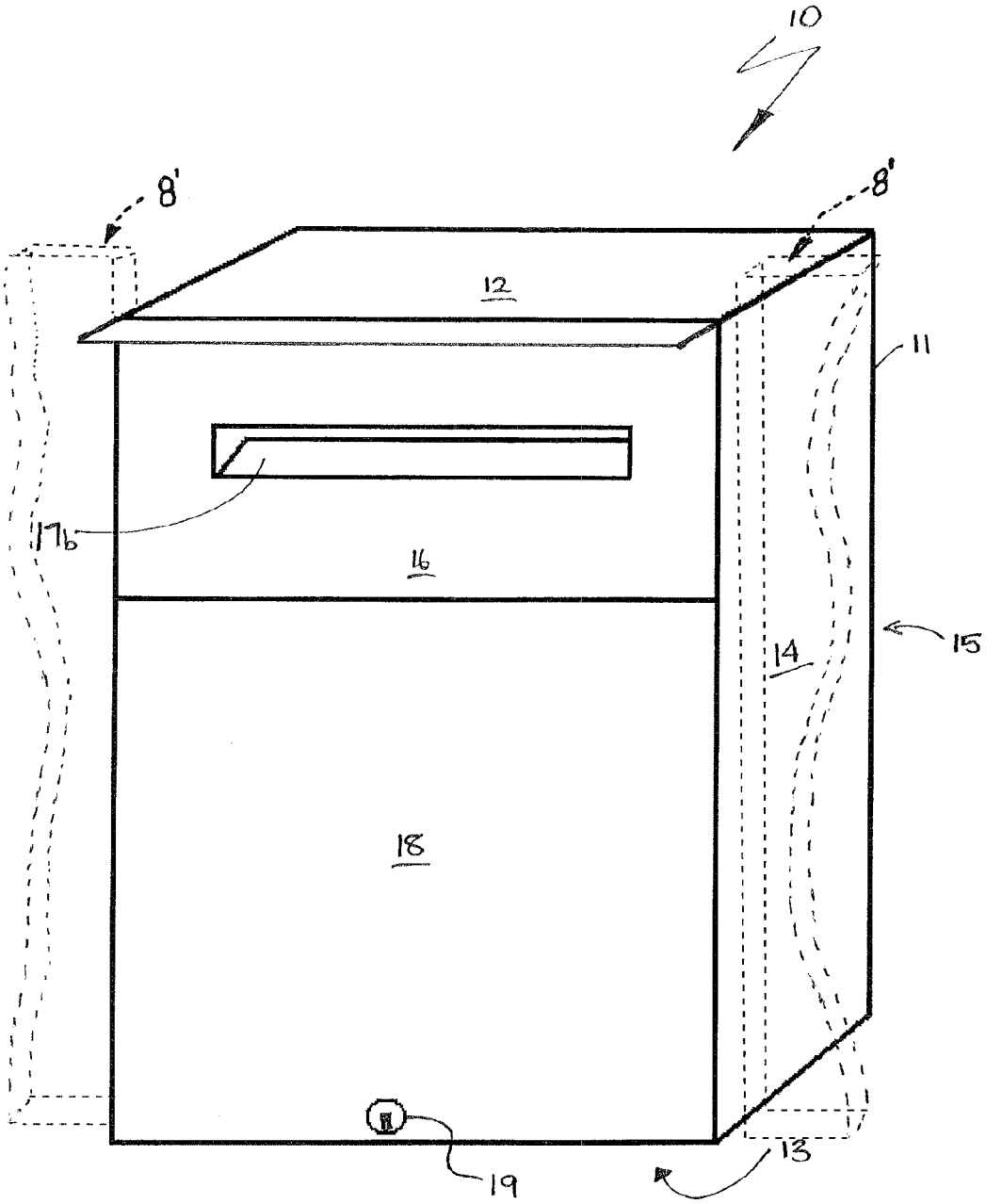
FIG. 1B is a front perspective view of a mail receptacle in accordance with another embodiment of the present invention.

Referring to FIGS. 1A and 1B, a receptacle 10 for receiving mail is shown. The receptacle 10 generally comprises a substantially rectangular body 11 having a top surface 12, a bottom or base 13, a pair of side walls 14 and a rear surface 15. The front surface of the receptacle 10 comprises a door 16 that opens outwardly to provide a means for accessing the internal storage area 20 of the receptacle 10 to deliver mail thereto.

In the embodiment as shown in FIG. 1A, to facilitate opening and/or closing of the door 16, a handle 17*a* is provided on the external surface of the door 16. The handle 17*a* may take a variety of forms other than that shown, to enable a user to easily use the door 16 as desired. In the embodiment as shown in FIG. 1B, instead of a handle 17*a*, a slot 7*b* is provided in the door 16. The slot 17*b* is sufficiently narrow to provide a deposit point for depositing envelopes and the like into the receptacle 10 without requiring the user to open the door 16. In this arrangement, the slot 17*b* may also function as a point for gripping the door 16 to facilitate opening of the door 16. However, it is also envisaged that a handle 17*a* may also be used in combination with the slot 17*b*.

In the embodiment as shown, an access panel 18 is also provided in the front surface of the receptacle 10 to provide a means for retrieving mail present within the storage area 20 of the receptacle. The access panel 18 comprises a lock 19 that secures the access panel 18 in a locked position to prevent unauthorised access to mail stored within the receptacle 10. The access panel is hingedly mounted to the body 11 along a top or bottom or side thereof to provide clear access to the storage area 20 of the receptacle 10 when the lock 19 is in an unlocked state. It will be appreciated that in an alternative embodiment, the access panel 18 may be provided on the rear surface 15 or in the side walls 14 depending upon space and design requirements.

The receptacle 10 as shown in FIGS. 1A and 1B may be provided as a stand-alone device or may be incorporated into a wall or fence structure 8 or 8' (both in phantom) as required. As previously mentioned the receptacle may assume a variety of shapes and sizes and is typically made from a durable material such as a sheet metal, such as stainless steel. In this regard, the receptacle provides a secure and substantially watertight storage compartment that protects mail stored therein from the weather elements as well as from pest damage, such as snails, insects and other pests that may damage mail stored therein.

Figure 2:
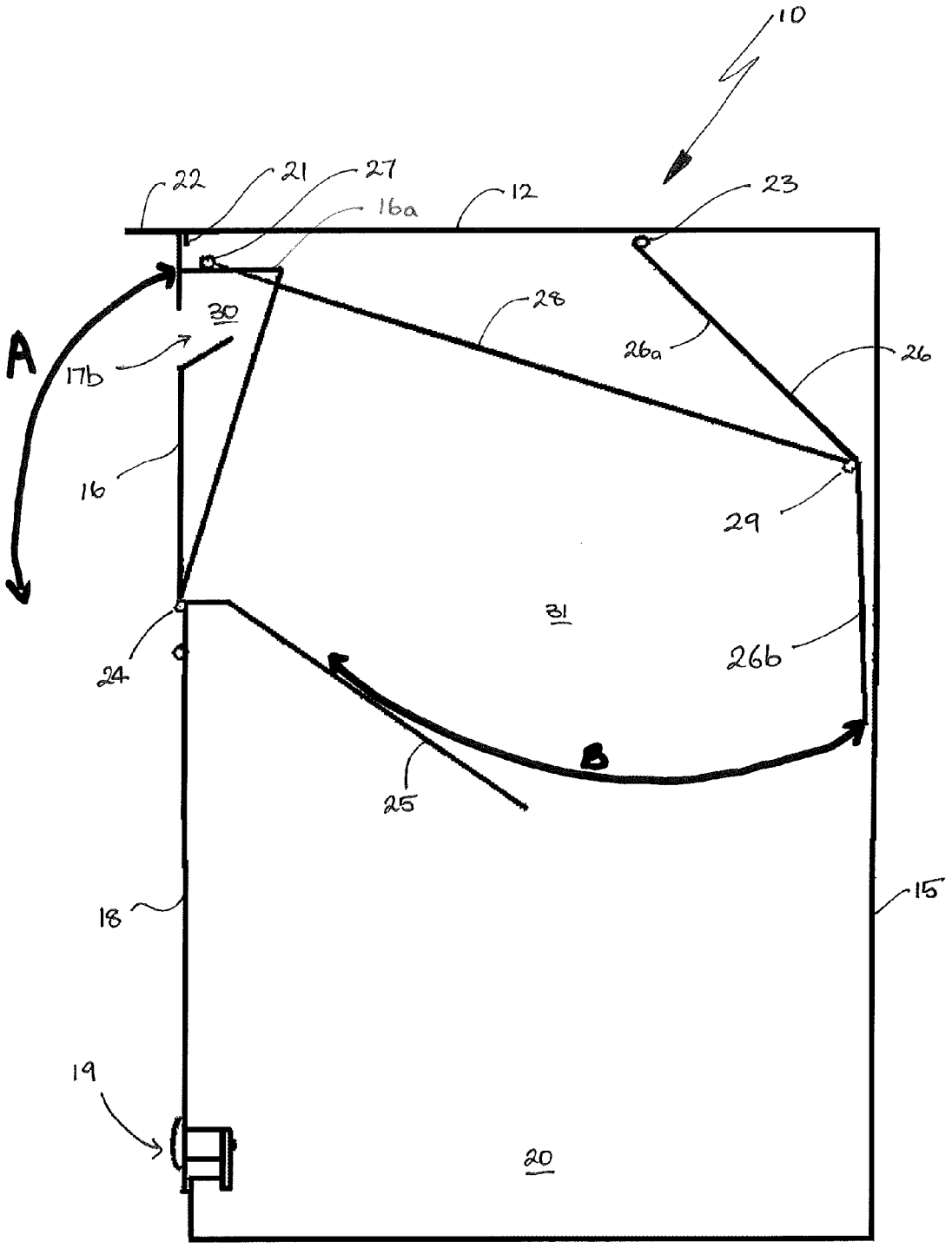
FIG. 2 is a cross-sectional side view of the mail receptacle of FIG. 1B with the door in a closed position.

Referring to FIG. 2, a cross sectional side view of the receptacle 10 is shown with the door 16 in a closed position. In the closed position, the door 16 abuts against a stop 21 that extends from an underside of the top surface 12 of the receptacle 10. In this position, a portion 22 of the top surface 12 of the receptacle is formed to project beyond the door 16 to provide a degree of protection from rain entering the receptacle 10 and to restrict access into the receptacle 10 to provide improved theft resistance. It will be appreciated that the stops may alternatively be provided in the side walls 14 of the body and acts to limit or prevent further movement of the door 16.

The door 16 is in the form of a substantially planar face member made from a sheet metal material or the like, and is pivotally mounted to the body 11 at pivot point 24. Pivot point 24 may be formed from one or more hinges, which may provide up to 360° movement, as desired. The pivot point 24 enables the door 16 to open in an outward direction with respect to the receptacle 10, along a path designated by arrow 'A' to provide access into the receptacle 10. In the embodiment as shown, a baffle or extension 16*a* is provided to extend from an upper inner surface of the door member 16, the purpose of which will be described in more detail below.

Within the receptacle 10 a ramp 25 is provided along a lower edge of the door 16. The ramp 25 is in the form of a downwardly angled extending surface that assists in directing any mail into the storage area 20 under the force of gravity, and also functions to provide security to the stored mail in a manner as will be described in more detail below.

As is shown in FIG. 2, the door 16 is connected to a closing member or flap 26 by way of one or more linkage members 28. The closing member 26 is mounted to an underside of the top surface 12 by way of a pivot 23. In this regard, the closing member 26 is mounted in an upper space of the receptacle towards the rear surface 15 thereof, and is able to swing within the internal upper space of the receptacle along an arc depicted as 'B'. Each linkage member 28 is pivotally mounted at one end to an upper region of the door 16 via a pivot point 27, and at the other end to the closing member 26 via pivot point 29. To provide improved strength and appropriate control of movement of the door 16 and closing member 26, a pair of linkage members 28 may be provided to extend along the side walls 14 of the body 11.

Figure 3:
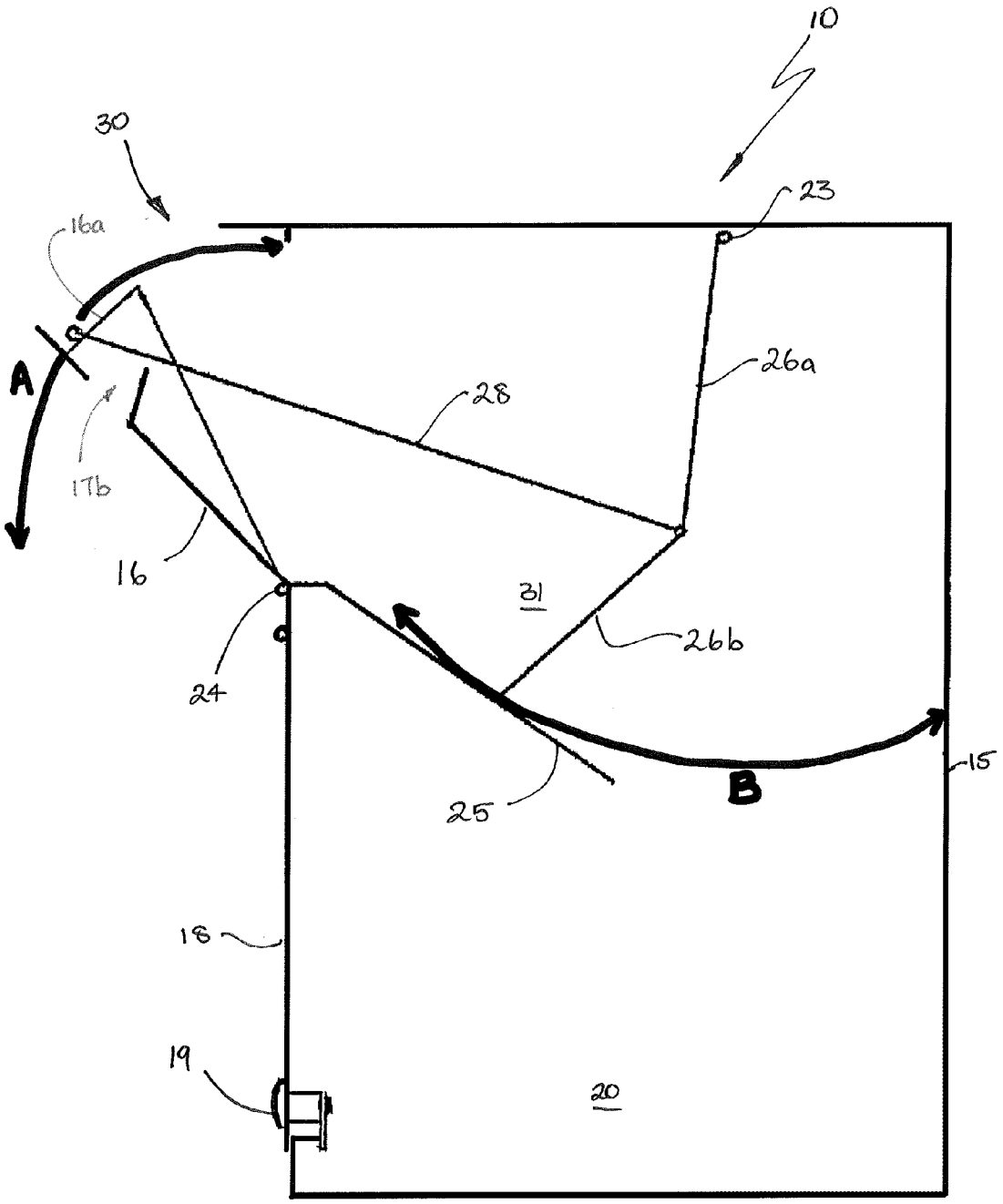
FIG. 3 is a cross-sectional side view of the mail receptacle of FIG. 1B with the door in a partially opened position.
Figure 4:
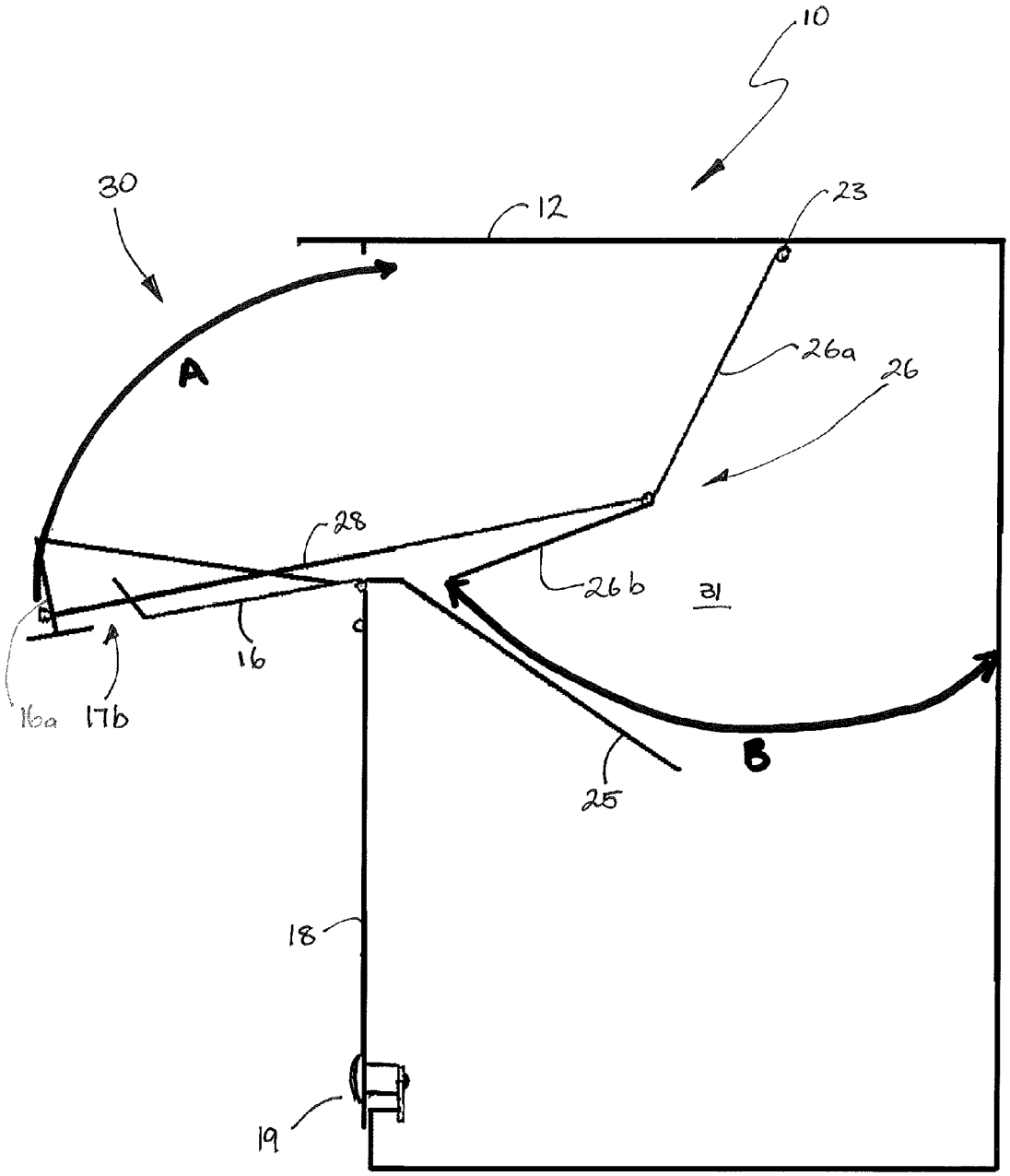
FIG. 4 is a cross-sectional side view of the mail receptacle of FIG. 1B with the door in a fully opened position.
Figure 5:
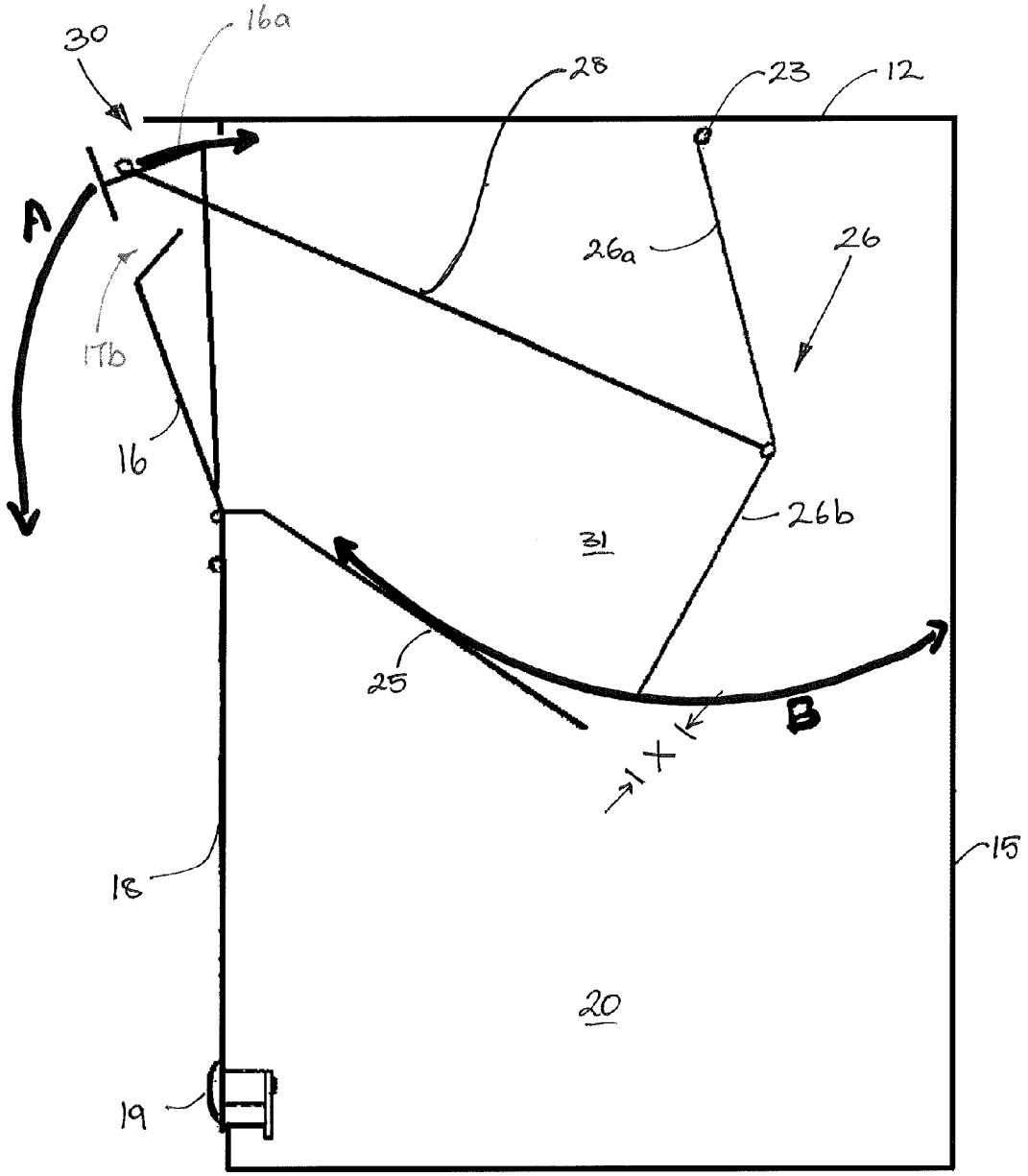
FIG. 5 is a cross-sectional side view of the mail receptacle of FIG. 1B with the door in a partially closed position.

In the arrangement as described above, movement of the door 16 from the closed position, as shown in FIG. 2, to an open or partially open position, as shown in FIGS. 3-5, along the path shown by arrow A, will cause the closing member 26 to swing towards the opening 30 of the receptacle along the path as shown by arrow 'B'.

In the embodiment as shown, the closing member 26 comprises an upper portion 26*a* and a lower portion 26*b*. The lower portion 26*b* is offset at an angle with respect to the upper portion 26*a*, in a manner as shown. Similarly, the pivot point 29 may also be offset from the face of the upper portion 26*a* and lower portion 26*b*. In this regard, when the door 16 is in a closed position, the upper portion 26*a* is configured to extend in a downward manner towards the rear surface 15 of the receptacle 10 and the lower portion 26*b* is configured to extend substantially along or close to the inner surface of the rear wall 15. Such an arrangement ensures that the closing member 26 does not substantially reduce the internal space of the delivery chute 31 to enable mail to pass substantially unimpeded from the opening 30 to the storage area 20. It will be appreciated that the lower edge of the lower portion 26*b* may be configured to function as a stop, in the same manner as stop 21, described previously. This may be achieved by providing a protrusion on the lower portion 26*b* or by angling the lower portion 26*b* of the closing member 26 such that it contacts the rear wall 15 when the door 16 is in the closed position, preventing any further movement of the door 16 and providing positive feedback to a user that the door 16 is in a closed position.

Referring to FIG. 3, the receptacle 10 is shown with the door 16 in a "half-opened" position after having travelled halfway along opening path 'A'. In this position, the opening 30 provides access into the receptacle 10 to enable some mail to be inserted into the receptacle. Due to the presence of the baffle 16*a* formed in the door 16, this baffle 16*a* functions to minimise the size of the opening 30 prevented to the user, as an additional security measure. In this position, the lower portion 26*b* of the closing member 26 has also moved towards the opening 30 along path 'B' such that the end of the lower portion 26*b* travels substantially along the surface of the ramp 25, or in close proximity thereto. The closing member thereby substantially closes the chute 31 to prevent access into the storage area 20. In this position, mail is able to be loaded into the chute 31 via the opening 30 for delivery into the storage area 20 when the door 16 is closed, as will be discussed in more detail below. As is clearly shown in FIG. 3, should an individual wish to seek unauthorised access to the storage area 20 to retrieve any mail present therein through the opening 30, the closing member 26 together with the ramp 25 prevents access to the storage area 20.

Should the mail to be received by the receptacle 10 include larger parcels or packages, the door 16 can be opened to its "fully opened" position, as shown in FIG. 4. In this position, the door 16 has travelled to the end position of path A and the closing member has also travelled to the end position of path B. The opening 30 is at its widest to enable the larger packages to be inserted through the opening 30 and into the chute 31. However, the mail is prevented from passage to the storage area 20 by way of the closing member 26 acting together with the ramp 25 to block the chute 31. Similarly, if an unauthorised user sought to reach into the storage area 20 in an attempt to remove any mail present therein, they are prevented from doing so, due to the interaction between the closing member 26 and the ramp 25. In such an instance, should an unauthorised user place any force against the closing member 26 in an attempt to gain access into the storage area 20, the door 16 will attempt to close about the person's arm, further preventing them from accessing any mail within the storage area 20.

As is shown in FIGS. 2-4, the manner in which the linkage between the door 16 and the closing member 26 is formed ensures that for a large majority of the instances where the door 16 is open or partially open, the door baffle 16*a* and the closing member 26 and ramp 25 function to close off access to the internal space 20. In FIG. 5, an instance is shown where the closing member 26 and ramp 25 are separated a small distance 'X' such that the chute 31 is partially opened to provide passage from the opening 30 into the storage area 20. However, in this instance the opening 30 is reduced by the overhang portion 22 of the top surface 12 and the baffle 16*a* thereby ensuring that the opening 30 is too small to permit a hand of an unauthorised person entering into the chute 31. Also, any attempt to widen the opening 30 will result in the closing member moving forward to close the chute 31. It will be appreciated that there is no requirement to provide both the overhang portion 22 and the door baffle 16*a* to achieve this, and either or neither of these features may be employed and the receptacle would still achieve its desired function.

With regard to the manner in which the receptacle 10 is able to receive a large parcel, the door 16 is firstly opened to its widest position as is shown in FIG. 4. The parcel is then able to be positioned within the opening 30 such that it is supported on the inner surface of the door 16 and lower portion 26*b* of the closing member 26. The user is then able to lift the door 16 to the closed position, as shown in FIG. 2. This action causes the closing member 26 to move towards the rear surface of the body 11, thereby opening the chute 31 to allow the parcel to enter the storage area 20 under gravity.

It will be appreciated that to assist in counterbalancing the weight of the closing member 26, the door 16 may have side panels formed on opposing sides of the door 16 to enable the door to become self closing and to avoid the likelihood of the door 16 being left in the open position. In another embodiment, counterweights may be rigidly attached to the interior of the door 16, and/or various spring mechanisms may be provided to facilitate automatic door closure, when released.

As previously discussed, the preferred embodiment of the present invention is to form the closing member 26 such that the lower portion 26*b* is offset at an angle to the upper portion 26*a*. However, in an alternative embodiment, the closing member may be substantially straight or may have a curve formed therein and still perform the function as described. In such an alternative embodiment, the closing member may assist in acting as a guide to direct mail into the storage area 20. It is also envisaged that the surface of the closing member may have one or more recesses or gaps formed therein, provided that such gaps are of a sufficient size to prevent unauthorised access into the storage area 20. Similarly, the surface of the ramp 25 may have one or more recesses or gaps formed therein, provided that such gaps are of a sufficient size to prevent unauthorised access into the storage area 20.

It will be appreciated that, with reference to FIG. 2, should a user wish to deposit an envelope into the receptacle 10 via slot 17*b*, this can be done without the need to open the door 16. In this arrangement the mail would enter the receptacle 10 via slot 17*b* and slide down ramp 25 to be directed into the storage area 20 in a conventional manner.

It will be appreciated that a mail box formed in accordance with the present invention provides a secure receptacle with enhanced storage capacity over other similar devices. Existing mail boxes for receiving parcels and the like have been found to accommodate a maximum parcel size or around 270×130×91 mm when the package is rotated by hand as the door is closed. This then represents a maximum parcel volume of around 3.2 liters. In contrast, the receptacle of the present invention can accept a maximum parcel volume of around 22.1 liters. Therefore, it will be appreciated that the receptacle of the present invention improves space efficiency of the receptacle and enhances security to provide a mail box that can be used in a variety of different situations to receive and store a variety of different types of mail in a secure manner.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the receptacle uppermost.

It will be appreciated by those skilled in the art that many modifications and variations may be made to the methods of the invention described herein without departing from the spirit and scope of the invention.

The claims defining the invention are as follows:

1. A receptacle for receiving and securely storing mail and parcels comprising:

a body defining an opening through which the mail and parcels are received and a storage area into which the mail and parcels are stored;

a door member pivotably mounted within said opening, the door member being configured to close said opening when in a closed position and to pivot away from said body to facilitate access to said opening when in an opened position;

a ramp member separate from the door member, immovably mounted within said body and configured and located to supportingly receive thereon the mail and parcels from the opening and to direct the mail and parcels into the storage area; and a closing member separate from the door and ramp members, pivotably mounted within said body so as to be movable with respect to the body and the door member yet linked via a linkage to the door member such that movement of said door member from said closed position to said opened position causes the closing member to pivot towards said ramp member such that the ramp member and the closing member function to substantially prevent access to said storage area from said opening when the door member is in an open position.

2. A receptacle according to claim 1, wherein the ramp member comprises a substantially planar member mounted to the body below said opening, the substantially planar member having a downwardly directed portion that defines a surface for receiving the mail and parcels and directing the mail and parcels into the storage area.

3. A receptacle according to claim 2, wherein the closing member travels over the surface of the downwardly directed portion of the substantially planar member to substantially prevent access to the storage area from said opening when the door member moves from said closed position to said opened position.

4. A receptacle according to claim 3, wherein the closing member comprises a substantially planar flap member that extends at least partially across an internal region of the body.

5. A receptacle according to claim 4, wherein the flap member is mountable to an upper region of the body by one or more hinges to facilitate pivotal movement of the flap member within said body.

6. A receptacle according to claim 5, wherein the flap member has a lower edge that travels over the surface of the downwardly directed portion of the substantially planar member such that the gap between the lower edge of the flap member and the surface of the downwardly directed portion of the substantially planar member is reduced to substantially prevent access to said storage area from said opening when the door member moves from said closed position to said opened position.

7. A receptacle according to claim 1, wherein the door member has a slot formed therein through which mail is inserted for receipt within the storage area without requiring said door member to be opened.

8. A receptacle according to claim 1, wherein the door member comprises a baffle member that extends substantially orthogonally with respect to the door member along an inner and upper edge thereof.

9. A receptacle according to claim 1, wherein the receptacle is incorporated within a fence or wall.

10. A receptacle for receiving and securely storing mail and parcels comprising:

a body defining an opening through which mail and parcels are received and a storage area beneath the opening into which the received mail and parcels are stored;

a door member pivotably mounted within said opening, the door member being configured to close said opening when located in a closed position and to be pivoted away from said body to facilitate access to said opening when located in an opened position;

a ramp member separate from the door member and immovably mounted within the body at a location below the opening and above the storage area so as to supportingly receive on a top surface of the ramp member, the mail and parcels passed through the opening, and to direct the mail and parcels towards the storage area;

a closing member separate from the door and ramp members, the closing member being pivotably mounted within the body remote from the door member and pivot of the door member; and a linkage separate from each of the door and closing members, the linkage being secured directly with the closure member and secured directly with the door member so as be movable with respect to each of the door and closing members and to operably connect the closing member with the door member such that movement of the door member from the closed position away from the receiving member towards the opened position is transmitted through the linkage to pivot a lower edge of the closing member from a position away from the receiving member towards the receiving member and sufficiently closely to substantially prevent access to the storage area from the opening when the door member moves from said closed position to said opened position.

11. A receptacle according to claim 10, wherein the linkage further pivots the closure member away from the ramp member through movement of the door member to the closed position so as to release the mail and parcels deposited on the ramp member.

12. A receptacle according to claim 10, wherein the closing member comprises a bent flap member mounted to the body proximal a top wall of the body so as to pivot within the body and move a lower edge from a position remote from the ramp member towards and across the ramp member as the door member pivots from the closed position to the opened position.

13. A receptacle according to claim 12, wherein the linkage comprises a rigid member pivotally connected at one end directly with the door member and pivotally connected at an opposing end directly with the bent flap member.

14. A receptacle according to claim 10, wherein the linkage comprises a rigid member pivotally connected at one end directly with the door member and pivotally connected at an opposing end directly with the closing member.

* * * * *